US009803606B2

(12) United States Patent
Schrade et al.

(10) Patent No.: US 9,803,606 B2
(45) Date of Patent: Oct. 31, 2017

(54) FUEL INJECTOR AND METHOD FOR FORMING SPRAY-DISCHARGE OPENINGS

(71) Applicant: Robert Bosch GmbH, Stuttgart (DE)

(72) Inventors: Andreas Schrade, Immenstadt (DE); Dieter Maier, Rettenberg (DE); Gerhard Stransky, Immenstadt (DE)

(73) Assignee: Robert Bosch GMBH, Stuttgart (DE)

( * ) Notice: Subject to any disclaimer, the term of this patent is extended or adjusted under 35 U.S.C. 154(b) by 125 days.

(21) Appl. No.: 14/516,690

(22) Filed: Oct. 17, 2014

(65) Prior Publication Data

US 2015/0034741 A1 Feb. 5, 2015

Related U.S. Application Data

(62) Division of application No. 11/990,053, filed as application No. PCT/EP2006/063176 on Jun. 14, 2016, now abandoned.

(30) Foreign Application Priority Data

Aug. 5, 2005 (DE) ..... 10 2005 036 951

(51) Int. Cl.
*B22F 3/00* (2006.01)
*F02M 61/18* (2006.01)
(Continued)

(52) U.S. Cl.
CPC ..... *F02M 61/1826* (2013.01); *B22F 3/004* (2013.01); *B22F 3/12* (2013.01);
(Continued)

(58) Field of Classification Search
CPC ... B22F 3/004; B22F 3/10; B22F 3/12; F02M 51/0671; F02M 61/1806; F02M 61/1826; F02M 61/1833
(Continued)

(56) References Cited

U.S. PATENT DOCUMENTS 4,890,794 A 1/1990 Imafuku et al.
5,163,621 A 11/1992 Kato et al.
(Continued)

FOREIGN PATENT DOCUMENTS

DE 42 30 376 4/1993
GB 1 088 666 10/1967
(Continued)

OTHER PUBLICATIONS

International Search Report for PCT/EP2006/063176, dated Aug. 28, 2006.

*Primary Examiner* — Arthur O Hall
*Assistant Examiner* — Viet Le
(74) *Attorney, Agent, or Firm* — Norton Rose Fulbright US LLP; Gerard Messina

(57) ABSTRACT

A fuel injector for fuel injection systems of internal combustion engines has an excitable actuator for activating a valve closing element, which forms a sealing seat together with a valve face implemented on a valve seat element. Multiple spray-discharge openings are implemented in the valve seat element downstream from the valve face. The fuel injector is distinguished in that the spray-discharge openings include at least one upstream first spray-discharge opening section and one downstream second spray-discharge opening section having a different opening width and a wall area of the second spray-discharge opening section of all spray-discharge openings on a semi-circle runs either parallel or at a right angle to the longitudinal axis of the valve seat element having the spray-discharge openings. The valve seat element is manufactured using metal injection molding methods.

9 Claims, 2 Drawing Sheets

(51) Int. Cl.
*F02M 51/06* (2006.01)
*B22F 3/12* (2006.01)
*B22F 5/10* (2006.01)

(52) U.S. Cl.
CPC ..... *B22F 5/10* (2013.01); *F02M 51/0671* (2013.01); *F02M 61/1806* (2013.01); *F02M 61/1833* (2013.01)

(58) Field of Classification Search
USPC ..... 239/533.12; 419/36
See application file for complete search history.

(56) References Cited

U.S. PATENT DOCUMENTS

| | | | | |
|---|---|---|---|---|
| 6,439,484 | B2 * | 8/2002 | Harata ..... | F02M 51/0614 239/552 |
| 2004/0074996 | A1 * | 4/2004 | Munezane ..... | F02M 51/0678 239/533.2 |
| 2004/0104285 | A1 | 6/2004 | Okamoto et al. | |
| 2004/0237929 | A1 | 12/2004 | Cavanagh et al. | |

FOREIGN PATENT DOCUMENTS

| | | |
|---|---|---|
| JP | 58 222 971 | 4/1984 |
| JP | 1-116280 | 5/1989 |
| JP | 3-182682 | 8/1991 |
| JP | 2004-137931 | 5/2004 |

* cited by examiner

FUEL INJECTOR AND METHOD FOR FORMING SPRAY-DISCHARGE OPENINGS

CROSS-REFERENCE TO RELATED APPLICATIONS

The present application is a divisional application of U.S. patent application Ser. No. 11/990,053, filed Apr. 26, 2010, which is a national phase to International Application No. PCT/EP2006/063176, filed Jun. 14, 2006, and claims priority to German Patent Application No. 10 2005 036 951.0, filed Aug. 5, 2005, all of which are hereby incorporated by reference in their entireties.

FIELD OF THE INVENTION

The present invention is directed to a fuel injector and a method for forming spray-discharge openings.

BACKGROUND INFORMATION

A fuel injector, which has a stepped spray-discharge opening, is discussed in GB 1,088,666 A. The spray-discharge opening is implemented originating from a chamber-shaped valve interior space into a first opening section having a very small opening width, which determines the flow rate, while an adjoining second opening section is significantly expanded. The second opening section may be designed to expand into either a cylinder or a cone. The spray-discharge openings are introduced using conventional technology, such as drilling, milling, embossing, or eroding.

A fuel injector having a valve needle manufactured using the so-called metal injection molding method (MIM method) is also discussed in DE 42 30 376 C1. For the valve needle, a tubular actuating part, which includes an armature section and a valve sleeve section, is produced by injection molding and subsequent sintering. The actuating part is subsequently bonded to a valve closing element section using a welded joint, so that the valve needle is composed of only two individual components. A continuous internal longitudinal opening is provided in the armature section and the valve sleeve section, in which fuel may flow in the direction of the valve closing element section and then exits from the valve sleeve section through transverse openings in the proximity of the valve closing element section. Therefore, slide molds are necessary when manufacturing the valve needle using the MIM method to form the transverse openings.

A binary binder system like the solid polymer solution for the metal injection molding technique is discussed in DE 40 33 952 C1. It is distinguished by the use of physiologically harmless low-molecular binder components and by dispensing with wetting agents. In this way, dense molded parts made of metal powders may be manufactured without problems by injection molding and the binder may be removed therefrom, without contraction or warping.

SUMMARY OF THE INVENTION

The fuel injector according to the exemplary embodiments and/or exemplary methods of the present invention has the advantage that it is particularly simple and cost-effective to manufacture. Ideally, the valve component having the spray-discharge openings, in particular the valve seat element, is manufactured using the metal injection molding method (MIM). The exemplary embodiments and/or exemplary methods of the present invention is distinguished in that a large number of stepped spray-discharge openings may be formed in a molded part manufactured using the MIM method with high precision while bound to the mold. The configuration and embodiment of the spray-discharge openings in the valve component according to the exemplary embodiments and/or exemplary methods of the present invention allow simultaneous forming of multiple reproducible spray-discharge openings.

Advantageous refinements of and improvements on the fuel injector described herein are made possible by the measures further described herein.

It is particularly advantageous that all spray-discharge openings of a semi-circle with their downstream spray-discharge opening sections are able to be axially or radially demoldable using a mold to be developed once.

It may be advantageous if multiple first spray-discharge opening sections discharge into a peripheral second spray-discharge opening section in the shape of a ring or a partial ring.

The method according to the present invention for forming spray-discharge openings having the characterizing features of claim 15 has the advantage that the ability to form the downstream spray-discharge opening sections of the spray-discharge openings axially or radially makes it possible to integrate the contours of the spray-discharge opening sections into an injection mold with a very high variance. Significant cost advantages result in relation to known approaches, because the spray-discharge openings having their spray-discharge opening sections may be manufactured while mold-bound. Known separate work steps for manufacturing the spray-discharge opening sections, such as punching, drilling, eroding, or laser drilling, may be dispensed with. The spray-discharge openings having their spray-discharge opening sections may be manufactured according to the present invention with high reproducibility and high quality features while maintaining all dimensional tolerances, shape tolerances, and position tolerances.

Exemplary embodiments of the present invention are illustrated in the drawings and explained in greater detail in the following description.

DETAILED DESCRIPTION

Figure 1:
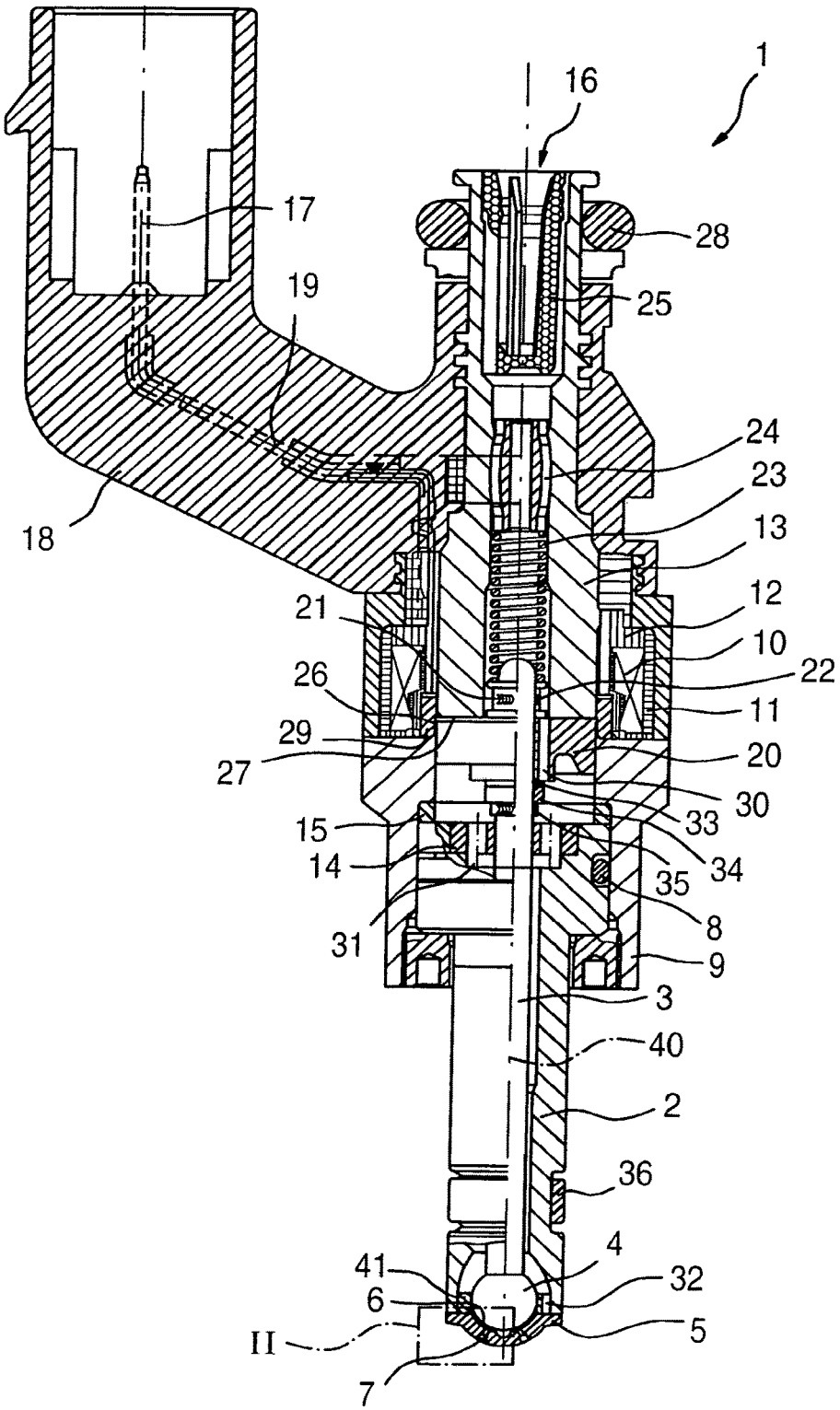
FIG. 1 shows a schematic section of an exemplary embodiment of a fuel injector having spray-discharge openings formed according to the exemplary embodiments and/or exemplary methods of the present invention in a valve seat element.

An exemplary embodiment of a fuel injector 1 illustrated in FIG. 1 is implemented in the form of a fuel injector 1 for fuel injection systems of mixture-compressing, spark-ignited internal combustion engines. Fuel injector 1 is suitable in particular for direct injection of fuel into a combustion chamber (not shown) of an internal combustion engine.

Fuel injector 1 includes a nozzle element 2 in which a valve needle 3 is situated. Valve needle 3 is operatively linked to a valve closing element 4, which works together with a valve face 6 situated on a valve seat element 5 to form a sealing seat. Fuel injector 1 in the exemplary embodiment is an inwardly opening fuel injector 1, which has at least two spray-discharge openings 7. Fuel injector 1 is ideally implemented as a multi-orifice injector, however, and therefore has between four and thirty spray-discharge openings 7. Nozzle element 2 is sealed against a valve housing 9 by a seal 8. An electromagnetic circuit, which includes a solenoid coil 10 as an actuator, which is encapsulated in a coil housing 11 and is wound on a coil support 12, which presses against an inner pole 13 of solenoid coil 10, is used as a drive, for example. Inner pole 13 and valve housing 9 are separated from one another by a constriction 26 and connected to one another by a non-ferromagnetic connection component 29. Solenoid coil 10 is excited via a line 19 by electrical current which may be supplied via an electrical plug contact 17. Plug contact 17 is enclosed by a plastic sheath 18, which may be sprayed onto inner pole 13.

Valve needle 3 is guided in a valve needle guide 14, which is designed to be disk-shaped. A paired setting disk 15 is used for setting the stroke. An armature 20 is located on the other side of setting disk 15. This armature is connected in a friction-locked manner via a first flange 21 to valve needle 3, which is connected by a weld seam 22 to first flange 21. A restoring spring 23 which is pre-tensioned in the present construction of fuel injector 1 by a setting sleeve 24 is supported on first flange 21.

Fuel ducts 30, 31, and 32 run in valve needle guide 14, in armature 20, and on guide element 41, respectively. The fuel is supplied via a central fuel supply 16 and filtered by a filter element 25. Fuel injector 1 is sealed by a seal 28 against a fuel distributor line (not shown further) and by a further seal 36 against a cylinder head (not shown further).

An annular damping element 33, which is made of an elastomer material, is situated on the downstream side of armature 20. It presses against a second flange 34, which is connected in a friction-locked manner to valve needle 3 via a weld seam 35.

In the rest state of fuel injector 1, restoring spring 23 is applied to armature 20 against its stroke direction in such a way that valve closing element 4 is held in contact with valve face 6 to form a seal. Upon excitation of solenoid coil 10, it builds up a magnetic field, which moves armature 20 against the spring force of restoring spring 23 in the stroke direction, the stroke being predefined by an operating gap 27 located in the rest position between inner pole 12 and armature 20. Armature 20 also carries along first flange 21, which is welded to valve needle 3, in the stroke direction. Valve closing element 4 connected to valve needle 3 lifts off of valve face 6 and the fuel is spray-discharged through spray-discharge openings 7.

If the coil current is turned off, armature 20 drops off of inner pole 13 due to the pressure of restoring spring 23 after the magnetic field has decreased sufficiently so that first flange 21, which is connected to valve needle 3, moves against the stroke direction. Valve needle 3 is thus moved in the same direction, causing valve closing element 4 to be seated on valve face 6 and fuel injector 1 to close.

According to the exemplary embodiments and/or exemplary methods of the present invention, spray-discharge openings 7 in valve seat element 5 are implemented specifically. Valve seat element 5 is advantageously manufactured using the so-called MIM method. The already known method, which is also referred to as metal injection molding (MIM), includes the manufacture of molded parts from a metal powder and a binder, e.g., a plastic binder, which are mixed with one another and homogenized, for example, using conventional plastic injection molding machines, and the subsequent removal of the binder and sintering of the remaining metal powder framework. The composition of the metal powder may be easily adjusted to optimum magnetic and thermal properties.

In fuel injectors 1 for direct injection of fuel into the combustion chamber of an internal combustion engine, there is a significant risk of coating formation on the downstream components, such as spray-orifice disks and valve seat elements. In particular, spray-discharge openings 7 are susceptible to coking of the free cross section, so that the desired injection quantities may disadvantageously be reduced. It is accordingly desirable to set the temperature economy in the area of the downstream end of fuel injector 1 around valve seat element 5 in a targeted way. In addition, it is to be ensured to the greatest extent possible that a constant volume flow quantity may be spray-discharged via spray-discharge openings 7 over the entire service life of fuel injector 1. It has been found that in particular in stepped spray-discharge openings 7, which have an opening width enlargement in the downstream direction, the tendency toward coating formation, coking, and thus the tendency of clogging of the free cross section of spray-discharge openings 7 is significantly reduced.

The exemplary embodiments and/or exemplary methods of the present invention is distinguished in that a large number of stepped spray-discharge openings 7 may be formed particularly simply and cost-effectively and with high precision while bound to the mold in a molded part manufactured using MIM methods, in valve seat element 5 here. In known spray-discharge openings of fuel injectors, which are implemented as multi-orifice valves, every spray-discharge opening and/or, for stepped spray-discharge openings, every downstream spray-discharge opening section, has a separate spatial angle. For optimized and cost-effective and thus simultaneous forming of multiple spray-discharge openings 7, such a configuration and design of spray-discharge openings 7 in valve seat element 5 are more difficult.

It is therefore particularly advantageous to form stepped spray-discharge openings 7 specifically. In the metal injection molding process for manufacturing valve seat element 5, spray-discharge openings 7 may be formed especially favorably if all spray-discharge openings 7 of a semi-circle have a wall area 42 running parallel to longitudinal axis 40 of the valve component having spray-discharge openings 7, valve seat element 5 here, at least in their particular downstream spray-discharge opening section 7". Longitudinal axis 40 of valve seat element 5 is coincident with the valve longitudinal axis in the exemplary embodiments shown. However, valve seat element 5 may also be attached at an angle to fuel injector 1 for diagonal spray-discharge.

Figure 2:
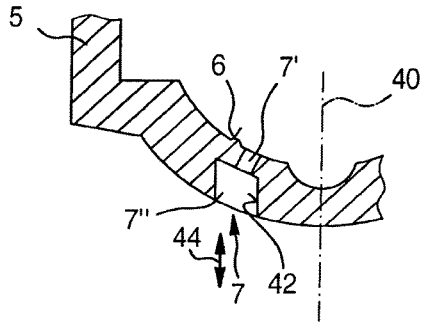
FIG. 2 shows detail II in the area of a spray-discharge opening in FIG. 1 in an enlarged illustration, the spray-discharge opening being implemented in a first embodiment.

FIG. 2 shows detail II in the area of a spray-discharge opening 7 in FIG. 1 in an enlarged illustration in a first embodiment, it being clear that spray-discharge opening 7 includes two spray-discharge opening sections 7', 7". Upstream first spray-discharge opening section 7' has a significantly smaller opening width than downstream following second spray-discharge opening section 7". The orientation of both spray-discharge opening sections 7', 7" of one spray-discharge opening 7 may differ. However, wall area 42 of second spray-discharge opening section 7" of all spray-discharge openings 7 on a semi-circle, which runs parallel to longitudinal axis 40, is essential. Parallel wall area 42 is to lie on the interior side toward longitudinal axis 40. As shown in FIG. 2, entire spray-discharge opening section 7" may also run axially parallel.

Figure 3:
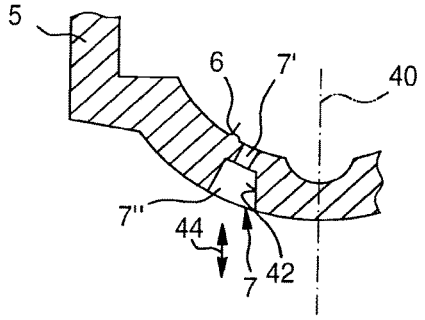
FIG. 3 shows a valve seat element having a spray-discharge opening in a second embodiment in a detail illustration comparable to FIG. 2.

A second exemplary embodiment of a spray-discharge opening 7 in a valve seat element 5 is shown in FIG. 3 in a detail illustration comparable to FIG. 2. Again, wall area 42 implemented on the interior side toward longitudinal axis 40 is configured to run parallel to longitudinal axis 40 here, while the wall area runs outward at an angle on the side distal to longitudinal axis 40. Arrows 44 in FIGS. 2 and 3 are to indicate that in such an embodiment of spray-discharge opening sections 7", all spray-discharge openings 7 may ideally be axially formed simultaneously while mold-bound in the MIM process.

Figure 4:
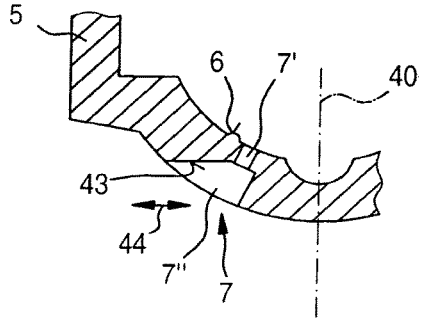
FIG. 4 shows a valve seat element having a spray-discharge opening in a third embodiment in a detail illustration comparable to FIG. 2.

In a third embodiment of a spray-discharge opening 7 in a valve seat element 5, which is also shown in a detail illustration comparable to FIG. 2 in FIG. 4, all spray-discharge openings 7 of a semi-circle are designed at least in their particular downstream spray-discharge opening section 7" in such a way that a wall area 43 runs at a right angle to longitudinal axis 40. Wall area 43 running at a right angle is to lie on the upper side toward valve face 6. The lower wall area distal from valve face 6 may run outward at an angle. Double arrow 44 in FIG. 4 indicates that in such an embodiment of spray-discharge opening sections 7", all spray-discharge openings 7 may ideally be radially demoldable while mold-bound simultaneously in the MIM process.

Instead of spray-discharge opening sections 7" for each individual spray-discharge opening 7, downstream spray-discharge opening 7" may also run around the circumference in a partial or a complete ring, into which some or all upstream spray-discharge opening sections 7' discharge. However, wall areas 42, 43 of spray-discharge opening section 7" in the shape of a partial or a complete ring are accordingly implemented either parallel or at a right angle to longitudinal axis 40 of valve seat element 5.

Due to the ability to axially or radially form spray-discharge opening sections 7" of spray-discharge openings 7, it is possible to integrate the contours of spray-discharge opening sections 7" in a very high variance in an injection mold. Significant cost advantages result in relation to known solutions, because spray-discharge openings 7 may be manufactured with their spray-discharge opening sections 7" while mold-bound. Known separate work steps for manufacturing spray-discharge opening sections 7", such as punching, boring, eroding, or laser boring, may be dispensed with. Spray-discharge openings 7 with their spray-discharge opening sections 7" may be manufactured according to the exemplary embodiments and/or exemplary methods of the present invention with high reproducibility and high quality features while maintaining all dimensional tolerances, shape tolerances, and position tolerances.

The exemplary embodiments and/or exemplary methods of the present invention is not restricted to the illustrated exemplary embodiments and is applicable, for example, for spray-discharge openings 7 situated in other ways and for any construction of inwardly opening multi-orifice fuel injectors 1. In particular, all features of the exemplary embodiments and/or exemplary methods of the present invention may be combined arbitrarily.

What is claimed is:

1. A fuel injector for a fuel injection system of an internal combustion engine, comprising:

an excitable actuator for activating a valve closing element, which forms a sealing seat together with a valve face implemented on a valve seat element; and a plurality of spray-discharge openings, which are implemented downstream from the valve face and integrally formed in the valve seat element, wherein:

each spray-discharge opening includes at least one upstream first spray-discharge opening section and one downstream second spray-discharge opening section having a different opening width;

the at least one upstream first spray-discharge opening section has a smaller opening width than the downstream second spray-discharge opening section;

a wall area of the second downstream spray-discharge opening section is parallel to a longitudinal axis of the valve seat element;

the upstream first spray-discharge opening section is a constant diameter; and the downstream second spray-discharge opening section is a variable diameter, wherein the opening width of the at least one upstream first spray-discharge opening section is less than half of the width of at least a portion of the downstream second spray-discharge opening section.

2. The fuel injector of claim 1, wherein the valve component having the spray-discharge openings is the valve seat element.

3. The fuel injector of claim 1, wherein the wall area of the spray-discharge opening section which runs parallel is on an interior side toward the longitudinal axis.

4. The fuel injector of claim 3, wherein a side of the wall area of the spray-discharge opening section distal from the longitudinal axis runs outward at an angle.

5. The fuel injector of claim 3, wherein the spray-discharge opening sections of all spray-discharge openings of a semi-circle are adapted to be axially demoldable simultaneously.

6. The fuel injector of claim 1, wherein each first spray-discharge opening section discharges into a second spray-discharge opening section of a spray-discharge opening.

7. The fuel injector of claim 1, wherein an alignment between the at least one first spray-discharge opening section and the second spray-discharge opening section of the same spray-discharge opening differs.

8. The fuel injector of claim 1, wherein the valve seat element having the spray-discharge openings is adapted to be manufacturable using metal injection molding.

9. The fuel injector of claim 1, wherein the valve seat element includes between two and thirty spray-discharge openings.

* * * * *